US005429362A

United States Patent [19]

Takemoto et al.

[11] Patent Number: 5,429,362

[45] Date of Patent: Jul. 4, 1995

[54] MEDAL DISPENSER FOR SLOT MACHINE

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 140,358

[22] Filed: Oct. 25, 1993

[30] Foreign Application Priority Data

Oct. 29, 1992 [JP] Japan ..... 4-291217

[51] Int. Cl.[6] ..... G07F 17/34; G07D 1/00

[52] U.S. Cl. ..... 273/143 R; 453/29; 453/63; 453/1; 453/18

[58] Field of Search ..... 453/29, 30, 58, 63, 453/1, 18; 273/143 R, 138 A

[56] References Cited

U.S. PATENT DOCUMENTS

| | | | |
|---|---|---|---|
| 3,717,158 | 2/1973 | Black | 453/30 |
| 4,509,542 | 4/1985 | Watanabe et al. | 453/63 |
| 4,822,235 | 4/1989 | Hipp et al. | 453/63 |

*Primary Examiner*—Benjamin H. Layno
*Attorney, Agent, or Firm*—Armstrong, Westerman, Hattori, McLeland & Naughton

[57] ABSTRACT

This invention enables coins, discharged from a discharge outlet after inserting a paper money, to be received effectively by a paper cup taken out from the storage portion without touching coins by hands. A coin dispenser for a slot machine which enables discharging desired number of coins from a discharge outlet 2 after inserting paper money into a paper money inlet 1. A supporting plate 4 is provided under an outlet 3*a* of a tray 3 located beneath said discharge outlet 2. A storage portion 5 which enables storage of many paper cups A is provided in a housing. The coins are enabled to discharge after the cup A is set on the supporting plate 4, furthermore the paper cup A can be manually or automatically moved from the storage portion 5 to the supporting plate 4. The outlet 3*a* of the tray 3 is freely opened and shut by lever operation.

5 Claims, 3 Drawing Sheets

MEDAL DISPENSER FOR SLOT MACHINE

BACKGROUND OF THE INVENTION

1. Field of the Invention

This invention relates to a coin dispenser for a slot machine in which coins, discharged from a discharge outlet, are received with a paper cup after inserting paper money into a paper money inlet.

2. Description of the Prior Art

In a prior coin dispenser for a slot machine which discharges the prescribed number of coins through a discharge outlet when paper money is inserted into a paper money inlet, the coins discharged through the discharge outlet are received in a tray whose internal surface is curved like that of a ball and a player scoops up the coins for moving them to a paper cup.

However, scooping up the coins in the tray makes hands dirty and is unsanitary. Furthermore operating the slot machine with dirty hands makes the machine dirty.

SUMMARY OF THE INVENTION

Accordingly, it is an object of the present invention to provide a coin dispenser for a slot machine that enables receiving coins in a paper cup with which the dispenser is equipped. To achieve this object, the coin dispenser is provided with a supporting member disposed under a tray located beneath a discharge outlet, which supporting member enables a paper cup to be set unmovably on it. Furthermore, the dispenser is provided with a storage portion which enables storage of many paper cups in it, The dispenser enables taking out the paper cup from the storage portion and setting it manually or automatically on the supporting member whereupon, by opening and closing an outlet of a tray by operation of a lever, discharge of coins can occur after the paper cup is set on the supporting member.

Thus, if paper money is inserted into the paper money inlet, the prescribed number of coins are discharged through the discharge outlet. In this case, if a paper cup is taken out from the storage portion manually or automatically and is set on the supporting member, coins discharged through the discharge outlet into the tray are discharged from the tray into the paper cup. Coins received in the tray can be discharged into the paper cup by opening the outlet of the tray by operation of the lever and the cup having coins in it can be taken out from the supporting member by hand.

DETAILED DESCRIPTION

Figure 1:
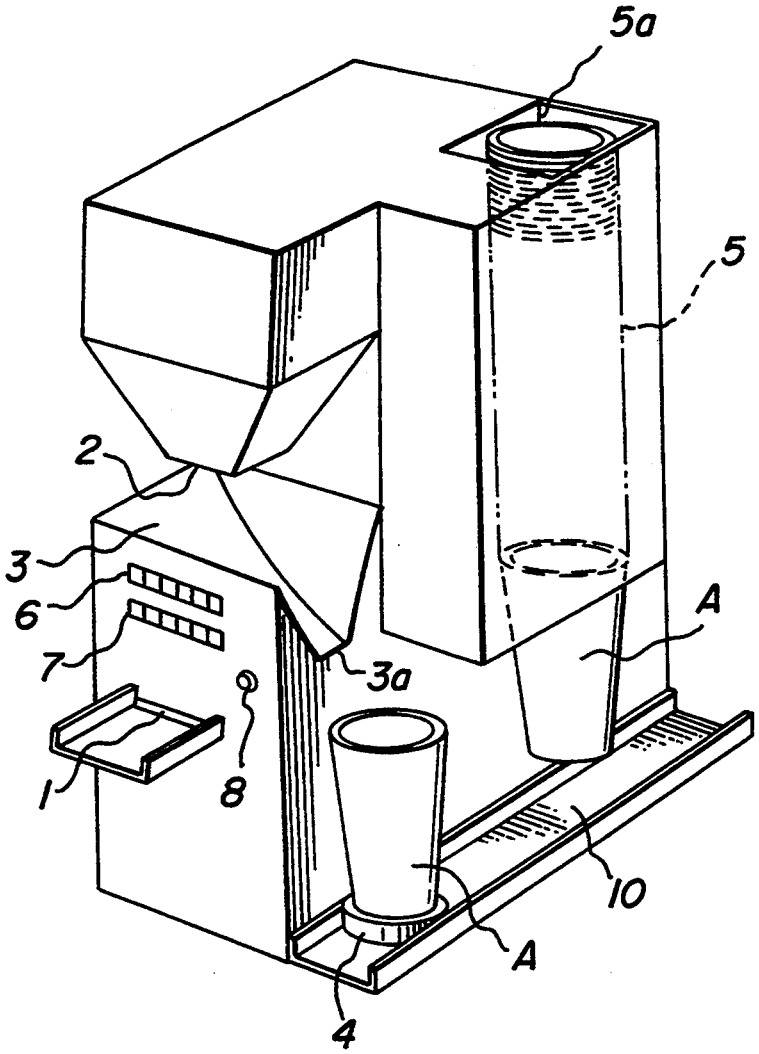
FIG. 1 is a perspective view of the first embodiment.
Figure 2:
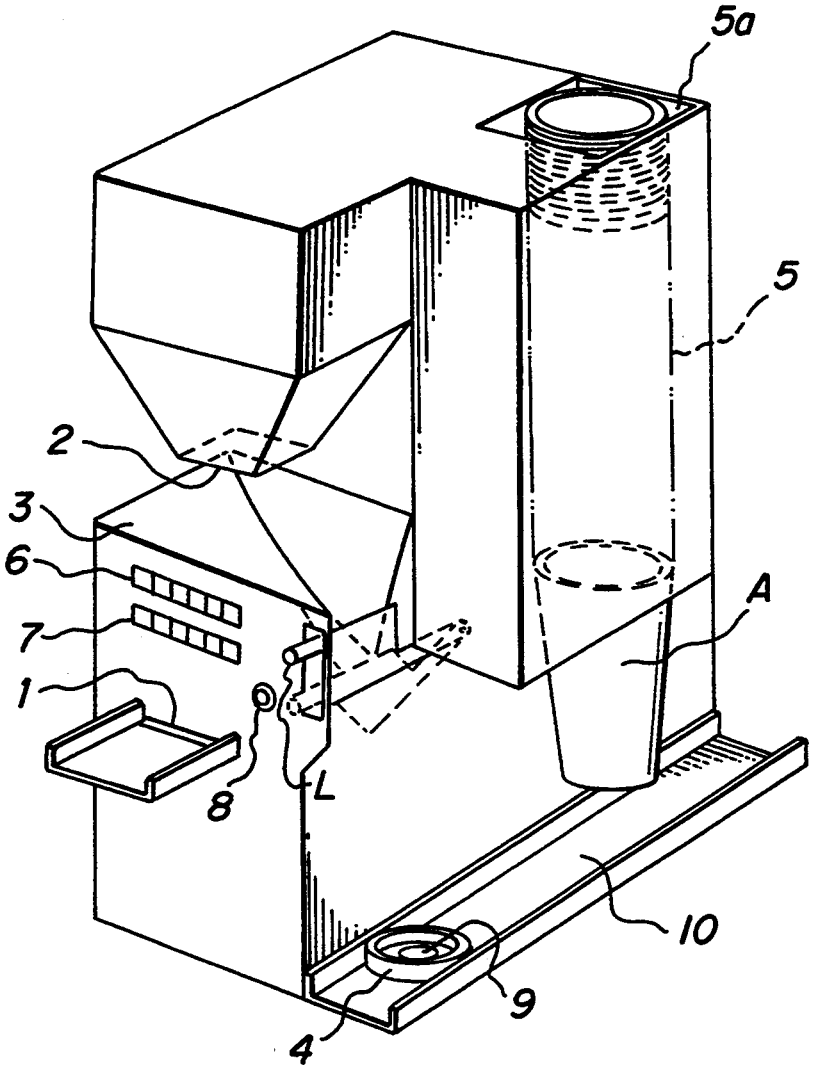
FIG. 2 is a perspective view showing a part of FIG. 1.

FIG. 1 and FIG. 2 illustrate the first embodiment of the present invention. The dispenser for a slot machine shown in the figures is provided with a paper money inlet 1 to insert paper money, a display 6 for indicating an amount of inserted money, a display 7 for indicating an amount of money exchanging for coins and switch 8 in the front lower portion of the dispenser, and a downwardly directed discharge outlet 2 in the front upper portion. A tray 3 whose bottom slopes down to an outlet 3*a* on the side portion is provided beneath said discharge outlet 2 and a supporting member 4 having a sensor 9 inside it is provided under the outlet 3*a* of said tray 3 for setting a paper cup A with respect to the tray outlet. Said supporting member 4 is provided on a plate 10 which is horizontally mounted to the lower side portion of the housing of the coin dispenser which also mounts a storage portion 5 formed above said plate 10, into which a plurality of paper cups A are installed through an upper opening 5*a* and which enables removal of the cups one by one by a player's hands from its lower portion.

So in the state illustrated in FIG. 2, if an amount of money inserted and a desired amount of coins to be exchanged for the money are individually indicated on displays 6 and 7 after inserting the paper money into the paper money inlet 1, and after a paper cup is manually taken out from the lower portion of said storage portion 5 and is set on the supporting member 4, the sensor 9 detects the paper cup and coins can be discharged. In the state illustrated in FIG. 1, if the switch 8 is pressed for discharging the prescribed number of coins from the discharge outlet 2, the coins fall into tray 3 and are discharged through the outlet 3*a* into the paper cup A. The paper cup A can be manually taken out from the supporting member 4.

A player may alternatively hold a cup just under the discharge outlet 2 for receiving coins in the paper cup.

Figure 3:
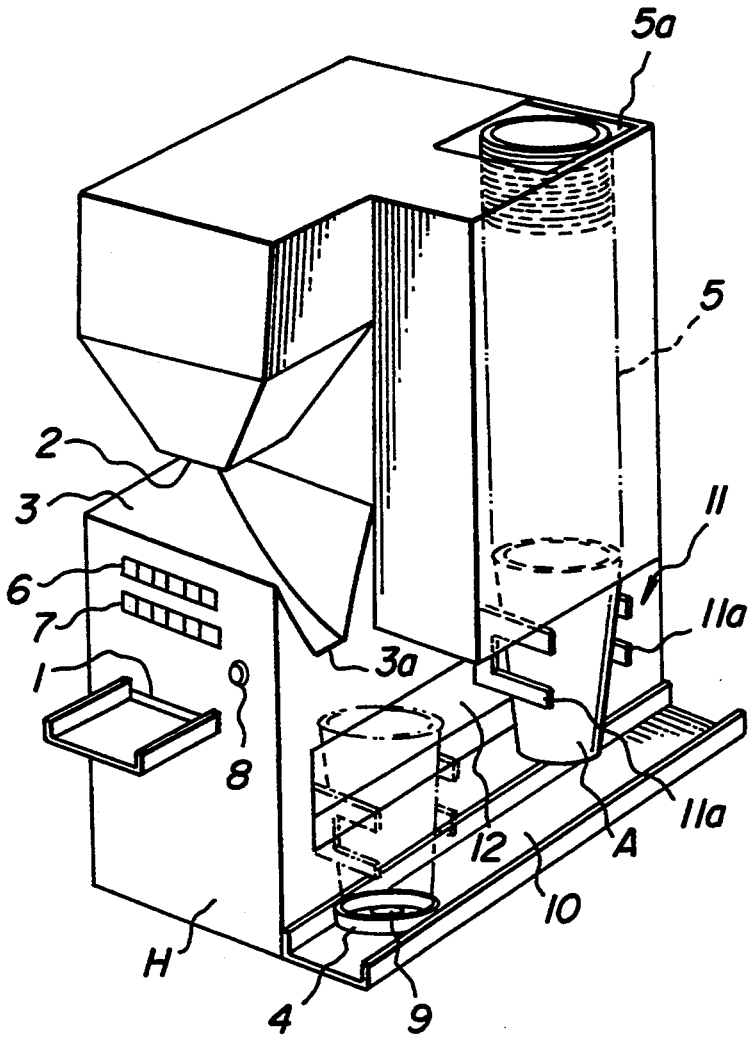
FIG. 3 is a perspective view of the second embodiment.

Referring to FIG. 3, there is shown a second embodiment of the present invention. The members and portions similar to those of the first embodiment are designated by the same characters. Although the construction is similar to that of the first embodiment, if paper money is inserted into a paper money inlet 1, a cup transfer apparatus 11 operates above the plate 10 and the lowest paper cup A disposed in the storage portion 5 can be moved automatically to the supporting member 4, whereupon coins can be received in the paper cup A on the supporting member 4 just like in the first embodiment.

If the outlet 3*a* of said tray 3 is constructed to be able to open and shut by operation of a lever, coins can be received in the paper cup A on the supporting member 4 by opening the outlet 3*a* by lever operation.

Also the outlet 3*a* of said tray 3 may be constructed to open when the paper cup A on the supporting member 4 is lifted by hand and the coins can then be discharged into the paper cup A.

Thus in the present invention, when a player would like to receive a desired number of coins from the discharge outlet 2 after inserting paper money into the paper money inlet 1, coins can be discharged from the discharge outlet 2 by transferring the paper cup A from the storage portion 5 manually or automatically and setting it on the supporting member. The discharged coins on the tray 3 can then be discharged directly from the outlet 3*a* into the paper cup A, therefore the player can receive the coins in the paper cup without making his hands dirty as in the prior art.

What is claimed is:

1. A coin dispenser for a slot machine which enables discharging a desired number of coins from a discharge outlet 2 after inserting paper money into a paper money inlet 1, comprising a supporting plate 4 for setting a paper cup A on the plate provided under an outlet 3*a* of a tray 3 located beneath said discharge outlet 2, and a storage portion 5 enabling storage of a plurality of paper cups A is provided in a housing.

2. A coin dispenser for a slot machine as claimed in claim 1, including a sensor 9 in the supporting plate operable to sense the presence of a cup therein and a coin discharge actuating switch 8 cooperable with said sensor 9 to enable the discharge of coins after the cup A is set on the supporting plate 4.

3. A coin dispenser for a slot machine as claimed in claim 1, wherein the paper cup A can be manually moved from the storage portion 5 to the supporting plate 4 for reception thereon.

4. A coin dispenser for a slot machine as claimed in claim 1, including transfer means operable for moving the paper cup A from the storage portion 5 to the supporting plate 4 for reception therein.

5. A coin dispenser for a slot machine as claimed in claim 1, including lever-operated means operably disposed in the outlet 3*a* of the tray 3 for controlling the discharge of coins therefrom.

* * * * *